United States Patent [19]

Dupree et al.

[11] 4,185,372

[45] Jan. 29, 1980

[54] WHEEL HUB SUPPORT REMOVAL MEANS

[76] Inventors: Clifford A. Dupree; Charles Entz, both of Rte. 1, Box 3, Holly, Colo. 81047

[21] Appl. No.: 955,000

[22] Filed: Oct. 26, 1978

[51] Int. Cl.[2] ..... B25B 27/14

[52] U.S. Cl. ..... 29/275; 29/280

[58] Field of Search ..... 29/275, 276, 255, 280; 145/46; 81/52.35

[56] References Cited

U.S. PATENT DOCUMENTS

| | | | |
|---|---|---|---|
| 1,958,674 | 5/1934 | Nusbaum | 29/275 |
| 2,089,902 | 8/1937 | Kulp | 29/275 |
| 2,462,774 | 2/1949 | Pollock | 29/275 |
| 3,206,843 | 9/1965 | Comire | 29/275 |

*Primary Examiner*—James L. Jones, Jr.

*Attorney, Agent, or Firm*—Richard D. Law

[57] ABSTRACT

An axle fitting tube with a key for riding in the axle keyway includes an end for contacting a tapered sleeve at the keyway and an impact member adjacent the key to concentrate impact force on a tapered sleeve key frozen in the keyway.

6 Claims, 3 Drawing Figures

WHEEL HUB SUPPORT REMOVAL MEANS

This invention relates to a tool for removing a tapered sleeve, on a wheel hub support, frozen to a tractor final drive axle. Tapered, split sleeves, holding a wheel hub support are used on the drive axles of many farm-type tractors, for example, John Deere tractors. These tapered sleeves have a key which fits in a keyway in the axle and a lateral hub support, to which the tractor wheel is bolted. The lateral hub support, of course, has bolt holes for accomodating the bolts holding the wheels on the drive axle. The sleeves are steel as are the axles, and as such are subject to becoming rusty in the presence of moisture. The sleeves freeze on the axle with the keyway and the key rusting together, making removal of the sleeve very difficult.

According to the present invention, a tool is provided which includes a tube for slidably fitting the axle, and an extending portion on the tube impinges on the sleeve in the area of the keyway so that most of the force of a striking impact is directed in the area of the keyway. The tube includes an impact member for accepting the blows of a hammer-like impact tool. The tube is, also, provided with a guide key which rides in the keyway on an axle insuring proper positioning of the impact tool against the tapered sleeve mounted on an axle of a tractor.

OBJECTS AND ADVANTAGES OF THE INVENTION

Included among the objects and advantages of the invention is to provide a tubular impact tool for removing frozen tapered sleeves from an axle.

Another object of the invention is to provide a keyway guide for positioning the impact tool on a frozen sleeve.

Yet another object of the invention is to provide a tubular impact tool for removing frozen axle sleeves having an impact area for positioning in the area of the sleeve key fitting in the axle keyway.

Still another object of the invention is to provide a tubular tool with positioning means for a tractor axle with a strike impact member in position to impact the major force of a blow against the key of a frozen, tapered sleeve for a drive axle of a tractor.

These and other objects and advantages of the invention may be ascertained by reference to the following description and appended drawings.

GENERAL DESCRIPTION OF THE DRAWINGS

SPECIFIC DESCRIPTION OF THE DRAWINGS

Figure 3:
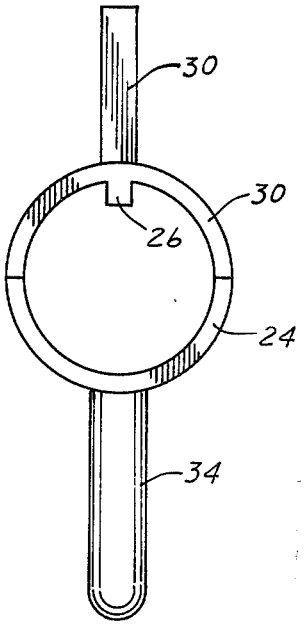
FIG. 3 is a front elevational view of the tool of FIG. 2.
Figure 1:
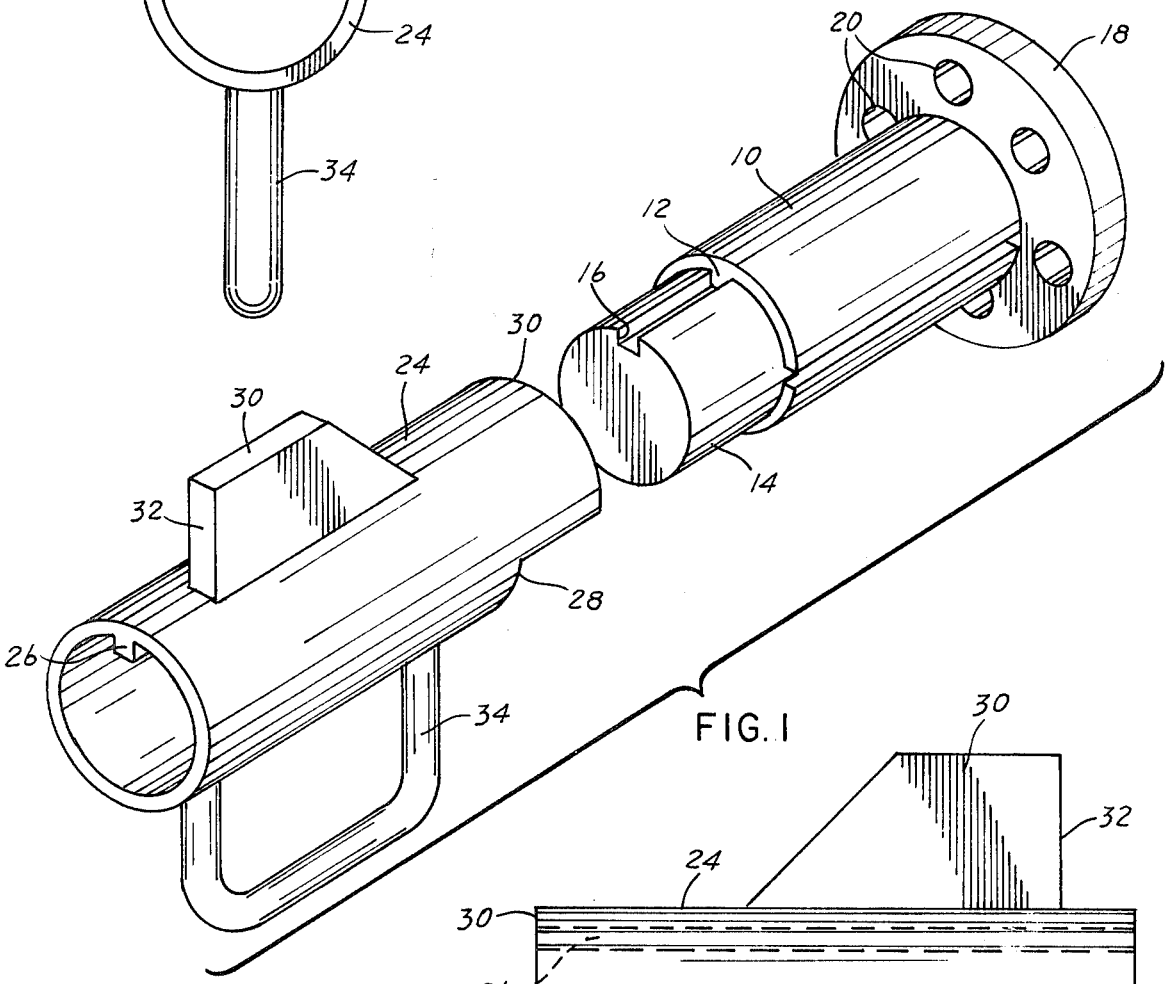
FIG. 1 is an exploded perspective view of a tool according to the invention, in position to be mounted on a tractor axle for impact removal of a frozen sleeve on the axle.
Figure 2:
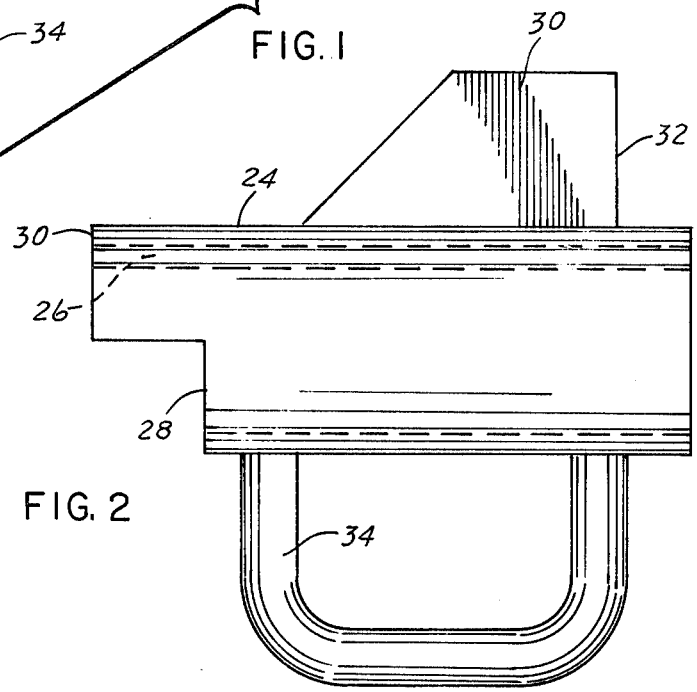
FIG. 2 is a side elevational view of a tool according to the invention.

In the device depicted in FIG. 1, a split, tapered sleeve 10 having a key 12, internally of the sleeve, is mounted on an axle 14 having a keyway 16 milled along the surface of the axle in axial alignment. A wheel hub support 18, with spaced bolt holes 20 which are arranged for bolting a tractor wheel to the support, is mounted on the split sleeve. The tapered sleeve is pressed on to the axle with a tight fit so that this final drive axle of the tractor can rotate the driving wheels of the tractor, usually the two rear tractor wheels.

The tool of the invention includes a tubular member 24 arranged for a sliding fit on an axle. The tubular member is provided with square cut (90°) ends. For John Deere Tractors, this usually requires three sizes of tubular members, but the invention may, of course, be provided in any other size. A key 26, of a size to provide a sliding fit in the keyway of the axle, is mounted axially in the tube and from end to end in the tube for most effective means. A cut-out 28 in one of the square ends of the tube leaves about one-half of the wall of the tube with a strike face 30 in an arc around the key 26. The face 30 is hemicircular and is a portion of the 90° square end cut providing a contact with the sleeve in the area of the key. A strike plate 30 with an impact area 32 is welded or otherwise secured to the tube on the surface of the tube, preferably radially from the keyway. This provides that the impact of a blow on the strike plate be imparted, in the main, on the key 26 and the strike area 30. A handle 34 provides a manipulative handhold.

An alternative form of the tool is a tubular member with a square cut end to provide a hemicircular strike area for the split sleeve and a circular plate welded or otherwise secured to the end of the tube opposite the lower tube cutout. The tube is, of course, provided with the key for sliding in the axle keyway, and thereby positioning the tube's strike area against the key of the sleeve. The manipulative handle provides positive control of the tool in transportation and positioning moves, however, it is not essential to proper functioning of the tool. It is important, however, that the tool be provided with a strike area which is adjacent to the sleeve key and which is about or is less than about half of the radial area of the tube wall to thereby insure a major impact force on the key of the sleeve.

In one common size, the tubular member is about 16 inches long, with a 4.5 inch O.D. and a 3.75 I.D. Other sizes are in the same general ratio, the major change being the axle size, which requires a change of the diameters of the tube to fit the axle and give sufficient wall thickness for the impact area.

While the invention has been described by reference to a particular embodiment, there is no intent to limit the spirit or the scope of the invention to the precise details set forth, except as defined in the following claims.

What is claimed is:

1. A tapered sleeve removing tool for sleeves having a key mounted on an axle having a keyway comprising:

(a) a tubular member having at least one 90° cut end;

(b) a cut away portion from said 90° cut end leaving about a hemicircular strike area;

(c) a key mounted internally of the tubular member generally at the mid point of the strike surface, and, (d) impact means mounted on said tubular member for receiving the blows of an impact member and transmitting the force thereof to said internal key and said strike area.

2. A tapered sleeve removing tool according to claim 1, wherein said tubular member is about the same size as the axle but freely slidable thereon.

3. A tapered sleeve removing tool according to claim 1, wherein said impact means includes an upstanding impact plate secured to the outside surface of said tubular member.

4. A tapered sleeve removing tool according to claim 3, wherein said impact means is an impact plate secured centerwise of the ends of said tubular member.

5. A tapered sleeve removing tool according to claim 1, being further characterized by manipulative handle means secured to said tubular member.

6. A tapered sleeve removing tool according to claim 5, wherein said impact plate is mounted centerwise of the surface of said tubular member radially of said keyway and said handle means is secured diametrically opposite said plate.

* * * * *